US007426842B2

(12) United States Patent
Hsieh

(10) Patent No.: US 7,426,842 B2
(45) Date of Patent: Sep. 23, 2008

(54) CYLINDER LOCK ASSEMBLY AND CORE CASING SET FOR A CYLINDER LOCK ASSEMBLY

(75) Inventor: Ping-Hung Hsieh, Taipei (TW)

(73) Assignee: Taiwan F Hsing Industrial Co., Ltd., Kaosiung Hsien (TW)

( * ) Notice: Subject to any disclaimer, the term of this patent is extended or adjusted under 35 U.S.C. 154(b) by 0 days.

(21) Appl. No.: 11/621,998

(22) Filed: Jan. 11, 2007

(65) Prior Publication Data

US 2008/0168812 A1 Jul. 17, 2008

(51) Int. Cl.
*E05B 27/06* (2006.01)

(52) U.S. Cl. ..... 70/358; 70/371

(58) Field of Classification Search ..... 70/358, 70/493, 392, 376, 367, 371, 372, 373
See application file for complete search history.

(56) References Cited

U.S. PATENT DOCUMENTS 5,209,087 A * 5/1993 Cox ..... 70/369
5,813,260 A * 9/1998 Widen ..... 70/369
6,076,380 A * 6/2000 Hulak ..... 70/14
6,076,386 A * 6/2000 Etchells et al. ..... 70/369
6,301,942 B1 * 10/2001 Shvarts ..... 70/367
6,935,146 B1 * 8/2005 Lin ..... 70/338
6,968,717 B2 * 11/2005 Suzuki et al. ..... 70/492
7,181,938 B2 * 2/2007 Price ..... 70/358
2003/0037579 A1 * 2/2003 Wu ..... 70/358
2005/0155399 A1 * 7/2005 Armstrong et al. ..... 70/493

* cited by examiner

*Primary Examiner*—Patricia Engle
*Assistant Examiner*—Kristina R Fulton
(74) *Attorney, Agent, or Firm*—Apex Juris, pllc; Tracy M Heims

(57) ABSTRACT

A cylinder lock assembly has an exterior housing, a core casing set and a core. The exterior housing has a through hole defined longitudinally through the exterior housing and a mounting hole defined in the exterior housing and communicating with the through hole. The core casing set is mounted slidably in the exterior housing and has a core casing and a retaining pin. The core casing has a central hole and a mounting aperture. The retaining pin is mounted slidably through the mounting aperture and has an inside end. The core is mounted in the central hole in the core casing and has keyhole having a stepped recess selectively engaging with the inside end of the retaining pin. A crash of the retaining pin and the stepped recess during the engagement notifies a user that the core and the core casing are released.

2 Claims, 10 Drawing Sheets

CYLINDER LOCK ASSEMBLY AND CORE CASING SET FOR A CYLINDER LOCK ASSEMBLY

BACKGROUND OF THE INVENTION

1. Field of the Invention

The present invention relates to a latch, and more particularly to a cylinder lock assembly that has an exterior housing, a core casing set and a core and indicates a user that the core and the core casing set are released and are ready to be detached when the user rotates the core to a specific angular position.

2. Description of Related Art

Cylinder lock assemblies are generally used in homes and offices, are mounted on doors to lock the doors. When a key for a cylinder lock assembly on an entrance is missed or a tenant holding the key moves out from a rental house, the cylinder lock assembly needs to be replaced. However, conventional cylinder lock assemblies are non-detachable so replacing the cylinder lock assemblies spends time and money.

With reference to FIGS. 10-13, a detachable cylinder lock assembly has been developed in order to avoid spending too much time and money in replacing the cylinder lock assembly on a door. The detachable cylinder lock assembly has a corresponding key (90) and comprises an exterior housing (60), a core casing (70) and a core (75).

The key has a notch (91).

The exterior housing (60) is cylindrical and has a central hole (61), a first channel (62), a second channel (63) and a mounting hole (64).

The central hole (61) is defined longitudinally through the exterior housing (60).

The first channel (62) is defined in the exterior housing (60) and communicates with and extends radially out from the central hole (61).

The second channel (63) is defined in the exterior housing (60) and communicates with and extends radially out from the central hole (61).

The mounting hole (64) is defined radially in the exterior housing (60) and communicates with the second channel (63).

The core casing (70) is longitudinal, is mounted slidably in the central hole (61) in the exterior housing (60) and has a front end, a rear end, a core hole, a faceplate (701), a top protrusion (71) and an inclined protrusion (80).

The core hole is defined longitudinally through the core casing (70).

The faceplate (701) is formed on the front end of the core casing (70).

The top protrusion (71) extends radially up from the core casing (70), is mounted slidably in the first channel (62) in the exterior housing (60) and has multiple outer bores (711), multiple outer tumblers (74), a cover (72) and multiple springs (73). The outer bores (711) are defined through the top protrusion (71) and communicate with the core hole. The outer tumblers (74) are slidably mounted respectively in the outer bores (711). The cover (72) is mounted on the top protrusion (72) and covers the outer bores (711). The springs (73) correspond respectively to the outer tumblers (74), are mounted respectively in the outer bores (711) and each spring (73) is mounted between a corresponding outer tumbler (74) and the cover (72).

The inclined protrusion (80) is formed on and protrudes radially from the core casing (70), is inclined up, is mounted slidably in the second channel (63) and has a longitudinal slot (81), a mounting slot (811), a retaining tab (82) and a biasing fastener (84). The longitudinal slot (81) is defined in the inclined protrusion (80). The mounting slot (811) is defined radially through the inclined protrusion (80), corresponds to the longitudinal slot (81), is aligned with the mounting hole (64) in the exterior housing (60) and communicates with the core hole in the core casing (70). The retaining tab (82) is mounted slidably through the mounting slot (811) and has a through hole (83) defined through the retaining tab (82). The biasing fastener (84) is resilient and U-shaped, is mounted in the longitudinal slot (81) and extends through the through hole (83) in the retaining tab (82) to fasten the retaining tab (82) in the mounting hole (64) in the exterior housing (60) and the mounting slot (811) in the inclined protrusion (80). Therefore, the core casing (70) is mounted securely in the exterior housing (60) by the retaining tab (82).

The core (75) is cylindrical, is mounted rotatably in the core hole in the core casing (75) and has a front end, a rear end, a keyhole (76), multiple inner bores (77), multiple inner tumblers (78), a recess (761), a driving shaft (85) and a mounting collar (86).

The inner bores (77) are defined radially in the core (75), correspond respectively to the outer bores (711) in the core casing (70) and respectively receive the outer tumblers (74) partially when aligned respectively with the outer bores (711).

The inner tumblers (78) are slidably mounted respectively in the inner bores (77) and are pushed inward respectively by the outer tumblers (74) when the inner bores (77) are aligned respectively with the outer bores (711).

The recess (761) is defined radially in the core (75), communicates with the keyhole (76) and corresponds to the notch (91) in the key (90).

The driving shaft (85) is formed on the rear end of the core (85) and may drive a door handle as the core (75) rotates.

The mounting collar (86) is mounted around the core (75) and abuts the rear end of the core casing (70) to prevent the core (75) from falling out of the core hole.

When the key (90) is inserted into the keyhole (76), the inner tumblers (78) are moved out to push the outer tumblers (74) back into the outer bores (711) so the core (75) may rotate freely in the core hole to open the door. When the core (75) is needed to be replaced, rotating the key (90) in the keyhole (76) to align the recess (761) in the core (75) with the mounting slot (811) in the inclined protrusion (80) causes the retaining tab (82) to engage with the recess (761) and the notch (91) in the key (90). In the engagement with the recess (761), the retaining tab (82) moves entirely out of the mounting hole (64) in the exterior housing (60) and the core casing (70) and the core (75) are released. Therefore, pulling the key (90) detaches the core casing (70) and the core (75) out from the exterior housing (60).

However, the rotation of the core (75) by the key (90) is smooth without any blocking feelings corresponding to the alignment of the recess (761) and the mounting slot (811) so that people would not be indicated that they have already achieved the specific angular position to detach the core casing (70).

To overcome the shortcomings, the present invention provides a cylinder lock assembly to mitigate or obviate the aforementioned problems.

SUMMARY OF THE INVENTION

The main objective of the invention is to provide a cylinder lock assembly that has an exterior housing, a core casing set and a core and indicates a user that the core and the core casing set are released and are ready to be detached when the user rotates the core to a specific angular position.

A cylinder lock assembly in accordance with present invention comprises an exterior housing, a core casing set and a core. The exterior housing has a through hole defined longitudinally through the exterior housing and a mounting hole defined in the exterior housing and communicating with the through hole. The core casing set is mounted slidably in the exterior housing and has a core casing and a retaining pin. The core casing has a central hole and a mounting aperture communicating with the central hole. The retaining pin is mounted slidably through the mounting aperture and has an inside end. The core is mounted in the central hole in the core casing and has keyhole having a stepped recess selectively engaging with the inside end of the retaining pin.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
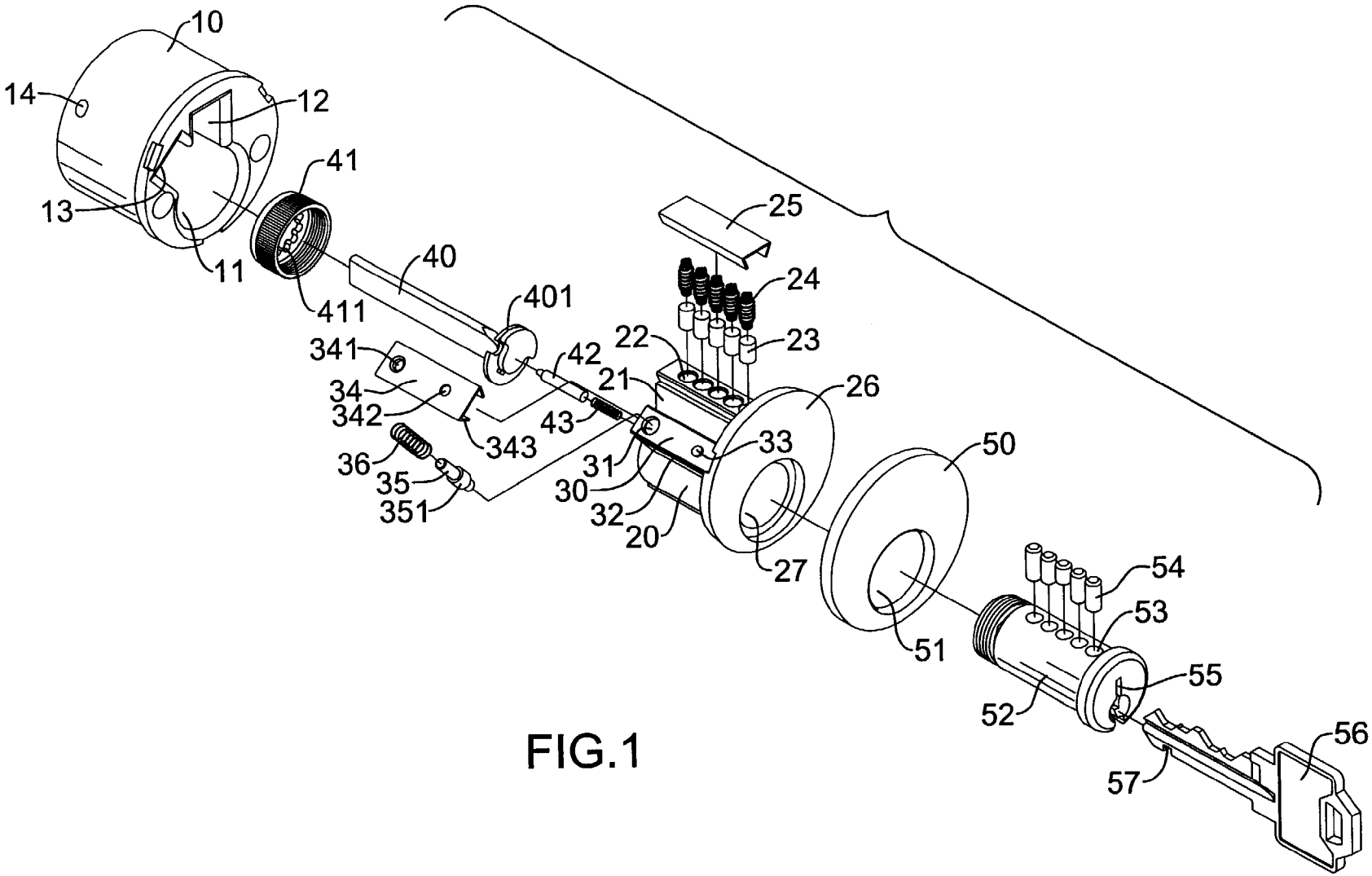
FIG. 1 is an enlarged perspective view of a first embodiment of a cylinder lock assembly in accordance with the present invention.
Figure 2:
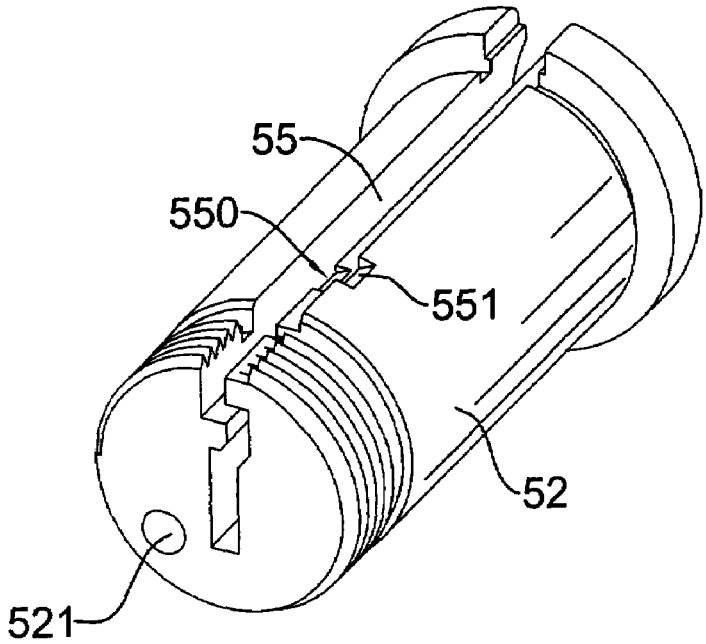
FIG. 2 is an a perspective view of the core of the cylinder lock assembly in FIG. 1.
Figure 11:
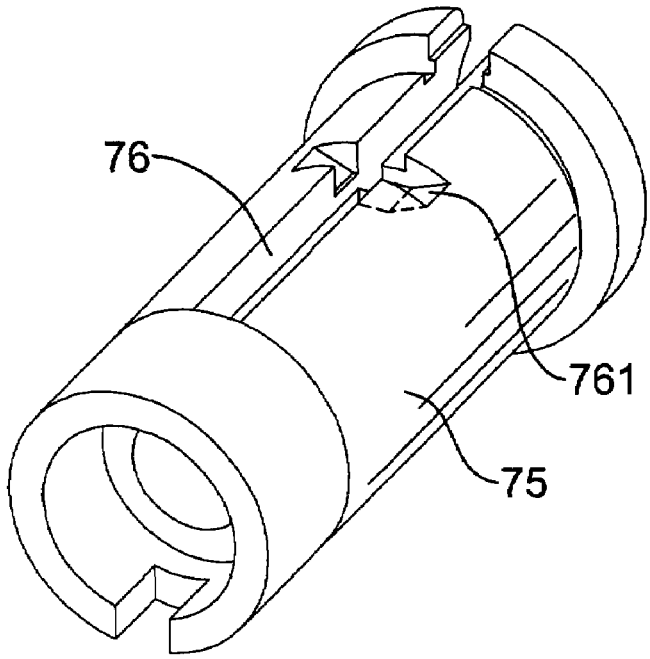
FIG.11 PRIOR ART
FIG. 11 is a perspective view of the core of the conventional cylinder lock assembly in FIG. 10.

With reference to FIGS. 1-6, a first embodiment of a cylinder lock assembly in accordance with the present invention is use with a key (56) having a notch (57) defined transversely in the key (56). The cylinder lock assembly comprises an exterior housing (10), a core casing set, a core (52) and a driving shaft assembly.

The exterior housing (10) is cylindrical and has a through hole (11), a first channel (12), a second channel (13) and a mounting hole (14).

The through hole (11) is defined longitudinally through the exterior housing (10).

The first channel (12) is defined in the exterior housing (10) and communicates with and extends radially out from the through hole (11).

The second channel (13) is defined in the exterior housing (10) and communicates with and extends radially out from the through hole (11).

The mounting hole (14) is defined transversely in the exterior housing (10), radially extends and communicates with in the through hole (11) and communicates with the second channel (13).

The core casing set is mounted slidably in the exterior housing (10) and has a core casing (20), a faceplate mount (26), a first protrusion (21), a second protrusion (30), a retaining pin (35), a second spring (36) and a faceplate (50). The core casing (20) is longitudinal, is mounted slidably and detachably in the through hole (11) in the exterior housing (10) and has a front end, a rear end and a central hole (27). The central hole (27) is defined longitudinally through the core casing (20).

The faceplate mount (26) is formed on the front end of the casing (26) around the central hole (27).

The first protrusion (21) is formed on and protrudes radially out from the core casing (20), is mounted slidably in the first channel (12) and has a multiple outer bores (22), multiple outer tumblers (23), a first cover (25) and multiple first springs (24). The outer bores (22) are defined through the first protrusion (21) and communicate with the central hole (27). The outer tumblers (23) are slidably mounted respectively in the outer bores (22). The first cover (25) is mounted on the first protrusion (72) and covers the outer bores (711). The first springs (24) correspond respectively to the outer tumblers (23), are mounted respectively in the outer bores (22) and each first spring (24) is mounted between a corresponding outer tumbler (23) and the first cover (25) and presses against the corresponding outer tumbler (23) radially inward.

The second protrusion (30) is formed on and protrudes radially from the core casing (70), is tapered toward the core casing (20), is mounted slidably in the second channel (63). The second protrusion (30) has two sides, a mounting aperture (31), a boss (33) and a second cover (34). The sides are inclined. The mounting aperture (31) is defined through the second protrusion (30), extends radially in and communicates with the central hole (27) and is aligned with the mounting hole (14) in the exterior housing (10). The mounting aperture (31) has an inner annular surface, an inside end and an inner annular flange (311) formed on and protruding radially inward from the inner annular surface. The boss (33) is formed on and protrudes out from the second protrusion (30). The second cover (34) is mounted on the second protrusion (30) and has two side tabs (343), an opening (341) and a mounting bore (342). The side tabs (343) are inclined and are mounted respectively on the sides of the second protrusion (30). The opening (341) is defined through the second cover (34) and is aligned with the mounting aperture (31). The mounting bore (342) is defined through the second cover (34) and is mounted securely around the boss (33).

Figure 3:
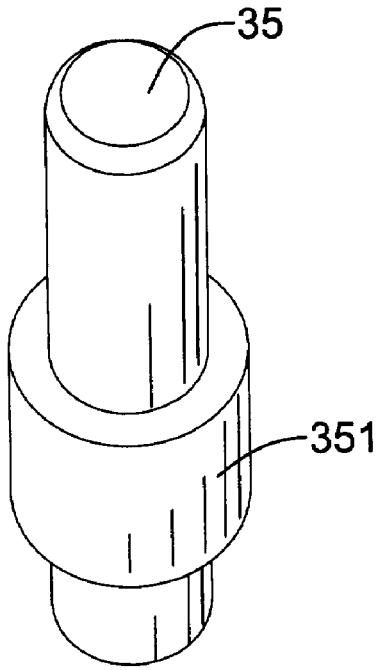
FIG. 3 is a perspective view of the retaining pin of the cylinder lock assembly in FIG. 1.

The retaining pin (35) is mounted slidably through the mounting aperture (31) in the second protrusion (30) and the opening (341) in the second cover (34) and extends in the mounting hole (14) in the exterior housing (10). The retaining pin (35) has a cross section, an inside end, an outside end and an outer annular flange (351). The inside end has an outer annular bevel edge. The outer annular flange (351) is formed on and protrudes radially out from the retaining pin (35) and selectively abuts the inner annular flange (311) in the mounting aperture (31) or the second cover (34). The cross section is circular, as shown in FIG. 3.

The second spring (36) is mounted in the mounting aperture (31) around the retaining pin (35), is mounted between the outer annular flange (351) and the second cover (34), presses against the second cover (34) and presses against the retaining pin (35) inward.

The faceplate (50) is mounted on the faceplate mount (26) and has a front opening (51) defined through the faceplate (50) and aligned with the central hole (27).

The core (52) is cylindrical, is mounted rotatably in the central hole (27) in the core casing (20) and has a front end, a rear end, a keyhole (55), a rear hole (521), multiple inner bores (53), multiple inner tumblers (54), an outer thread and a mounting collar (41).

The keyhole (55) is defined longitudinally through the core (52), extends radially out through the core (52) and may receive the key (56) so the core (52) may be rotated through the key (56). The keyhole (55) has a radial gap and a stepped recess (550). The radial gap is longitudinal, is defined radially in the core (52) and has two opposite parallel inner surfaces. One inner surface selectively abuts the inside end of the retaining pin (35). The stepped recess (550) is defined radially in the core (52) and is located adjacent to the other inner surface being opposite to the inner surface selectively abutting the inside end of the retaining pin (35), selectively engages with the inside end of the retaining pin (35) and has an upper step, a lower step and an inclined surface (551). The upper and lower steps are located in different radial levels. Accordingly, people rotating the key (56) with the core (52) would hear and feel the crash between the lower step and the retaining pin (35) when the inside end of retaining pin (35) moves in the stepped recess (550) and jumps from the upper step to the lower step. Furthermore, the retaining pin (35) engaging with the stepped recess (50) also hits and abuts the inner surface of the radial gap opposite to the stepped recess (550) to sound so that people may be clearly indicated that the retaining pin (35) has entirely moved into the stepped recess (50). The inclined surface (551) is formed on the upper step and the lower step as if the upper and lower steps were cut obliquely once. The inclined surface corresponds to the outer annular bevel edge of the inside end of the retaining pin (35).

The rear hole (521) is defined in the rear end of the core (52).

The inner bores (53) are defined radially in the core (52), correspond respectively to the outer bores (22) in the core casing (20) and respectively receive the outer tumblers (74) partially when aligned respectively with the outer bores (22).

The inner tumblers (54) are slidably mounted respectively in the inner bores (53) and are pushed inward respectively by the outer tumblers (23) when the inner bores (53) are aligned respectively with the outer bores (22).

The outer thread is formed around the rear end of the core (52).

The mounting collar (41) is mounted around the rear end of the core (52), abuts the rear end of the core casing (20) to prevent the core (52) from falling out of the core casing (20). The mounting collar (41) has a rear end, an annular inner surface, an inner thread, an annular lip and multiple keyways (411). The inner thread is formed on the annular inner surface and engages with the outer thread on the core (52). The annular lip is formed on and protrudes radially inward from the rear end of the mounting collar (41). The keyways (411) are defined radially in the annular lip.

The driving shaft assembly is mounted on the rear end of the core (52), is covered by the mounting collar (41) and has a shaft (40), a rod (42) and a spring (43). The shaft (40) is mounted on the rear end of the core (52), extends through mounting collar (40), may be connected to a handle on a door and has a front end, a rear end and a head (401). The head (401) is formed on the front end of the shaft (40), is covered and held by the mounting collar (40) and has an outer edge and an alignment notch defined in the outer edge. The rod (42) is mounted slidably in the rear hole (521) in the core (52), extends through the alignment notch in the head (401) of the shaft (40) and engages with one of the keyways (411) in the mounting collar (41) to hold the shaft (40) in a specific angular position.

When the key (56) insert the keyhole (55), the inner tumblers (54) are moved out to push the outer tumblers (23) back into the outer bores (22) so the core (52) may rotate freely in the central hole (27) to open the door. When the core (52) is replaced, rotating the key (56) in the keyhole (55) and aligning the stepped recess (550) in the core (52) with the mounting aperture (31) in the second protrusion (30) cause the retaining pin (35) to slide smoothly along the inclined surface (551) and engage with the stepped recess (550) and the notch (57) in the key (62). When engaging with the stepped recess (550), the retaining pin (35) jumps from the upper step to the lower step and hits the inner surface in the radial gap in the key hole (55), which sounds and vibrates to indicate people that the core casing (20) with the core (52) is free and ready to be detached. In the engagement with the stepped recess (550), the retaining pin (351) moves entirely out of the mounting hole (14) in the exterior housing (10) and the core casing (20) and the core (52) are released. Therefore, pulling the key (56) detaches the core casing (20) and the core (52) out from the exterior housing (10).

Figure 7:
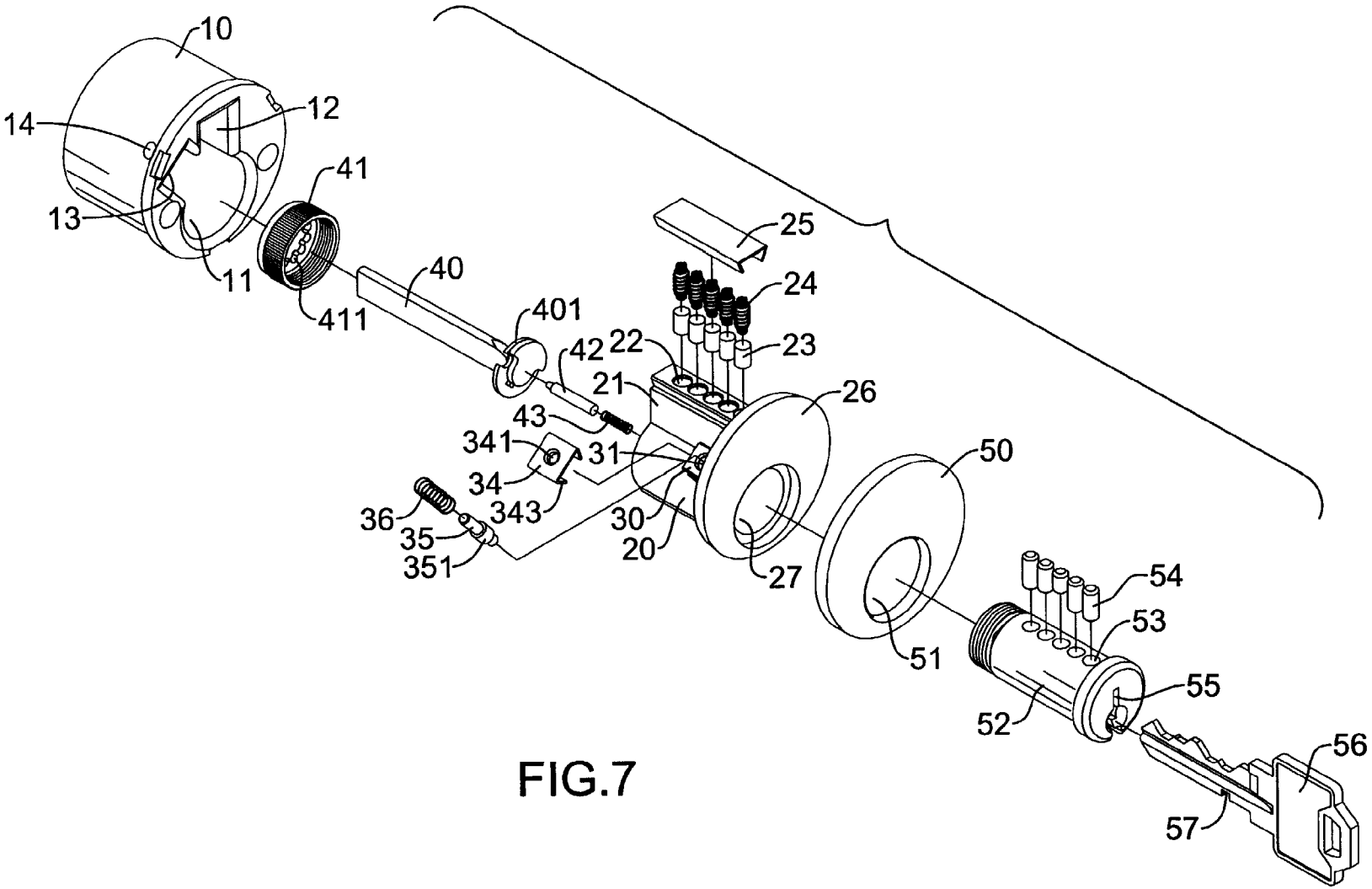
FIG. 7 is an enlarged perspective view of a second embodiment of the cylinder lock assembly in accordance with the present invention.

With reference to FIG. 7, a second embodiment of the cylinder lock assembly in accordance with the present invention has the second protrusion (30) shorter than that in the first embodiment and implemented without the boss. The second cover (34) is shorter than that in the first embodiment and is implemented without the mounting bore.

Figure 8:
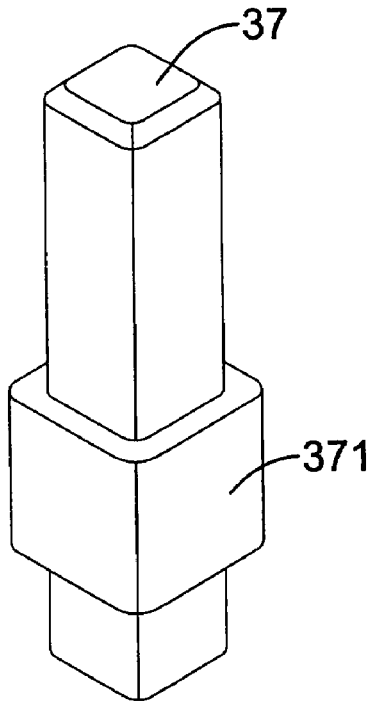
FIG. 8 is a perspective view of the retaining pin in a third embodiment of the cylinder lock assembly in accordance with the present invention.
Figure 4:
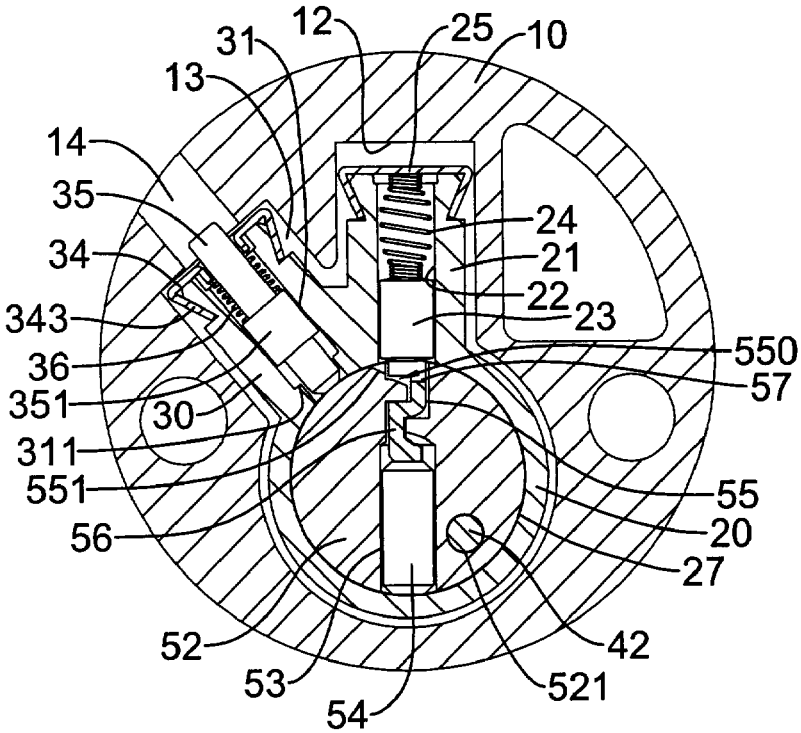
FIG. 4 is a front view in partial section of the cylinder lock assembly in FIG. 1.
Figure 6:
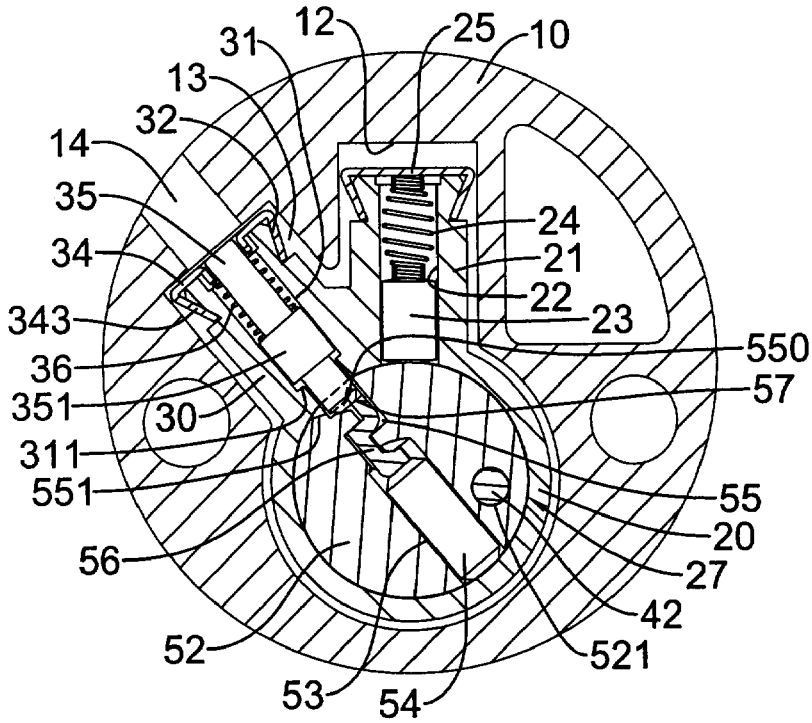
FIG. 6 is an operational front view in partial section of the cylinder lock assembly in FIG. 4 with the retaining pin engaging in the stepped recess and moving out of the mounting hole in the exterior housing so that the core casing with the core is released and is ready to be detached from the exterior housing.
Figure 5:
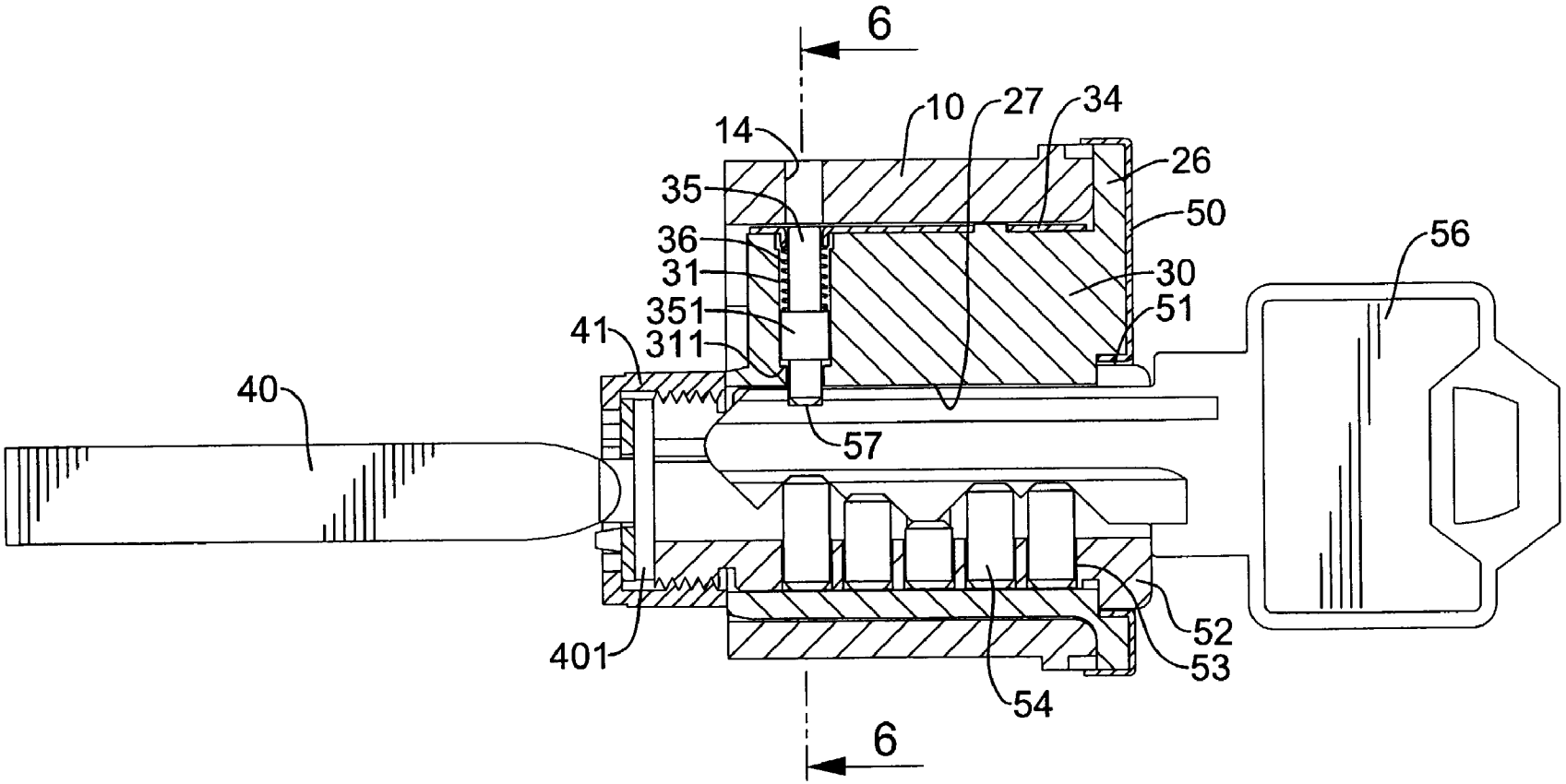
FIG. 5 is an operational side view in partial section of the cylinder lock assembly in FIG. 1 with the key inserted into the keyhole and pushing out the outer tumblers to rotate the core casing with the core relative to the exterior housing.

With reference to FIG. 8, a third embodiment of the cylinder lock assembly in accordance with the present invention has the cross section of the retaining pin (37) being rectangular. Also, the outer annular flange (371) has a rectangular cross section.

Figure 9A:
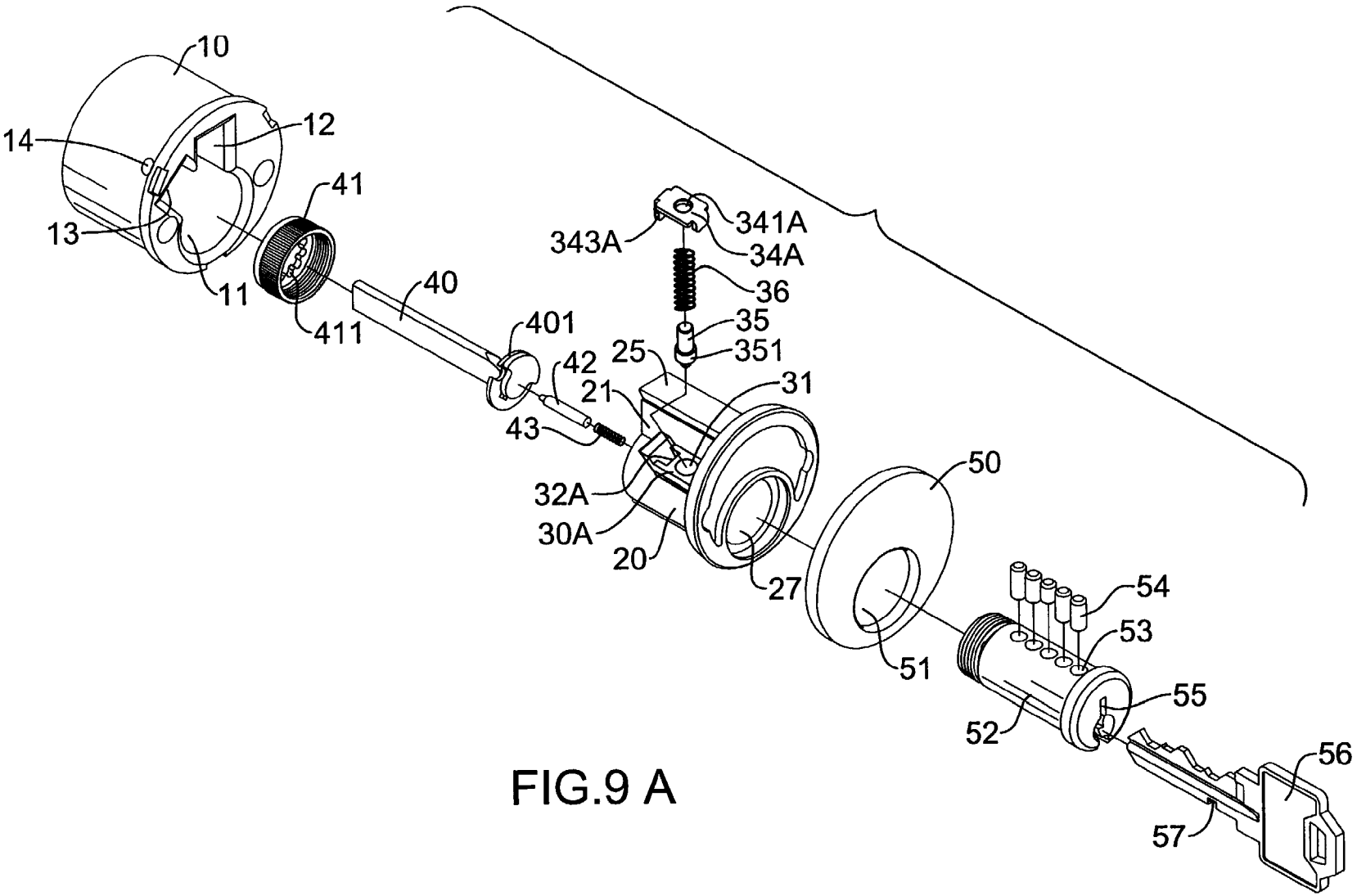
FIG. 9A is an exploded perspective view of a fourth embodiment of the cylinder lock assembly in accordance with the present invention.
Figure 9B:
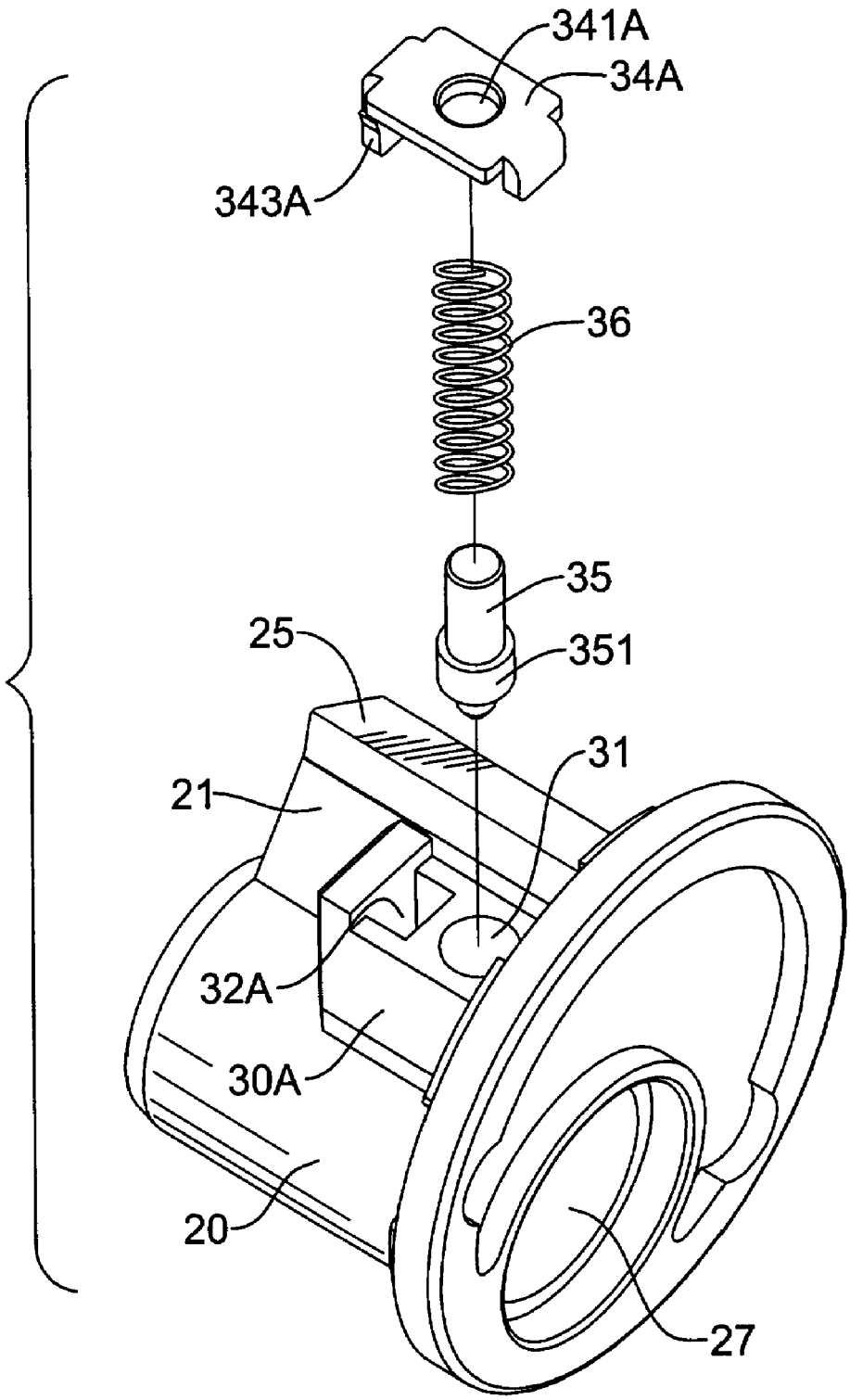
FIG. 9B is an enlarged and exploded perspective view of the core casing of the cylinder lock assembly in FIG. 9A.
Figure 10:
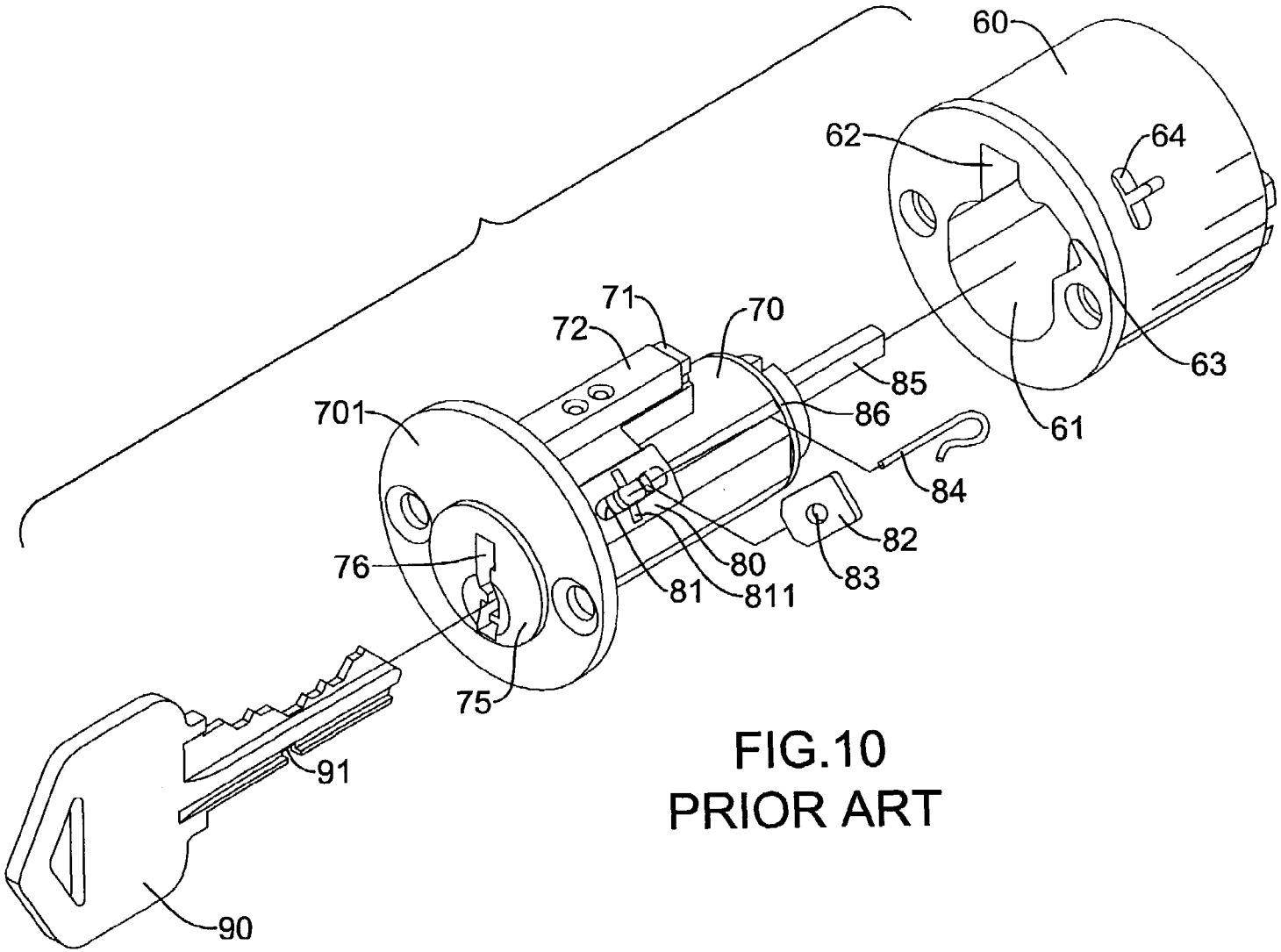
FIG.10 PRIOR ART
FIG. 10 is an enlarged perspective view of a conventional cylinder lock assembly in accordance with the prior art.
Figure 12:
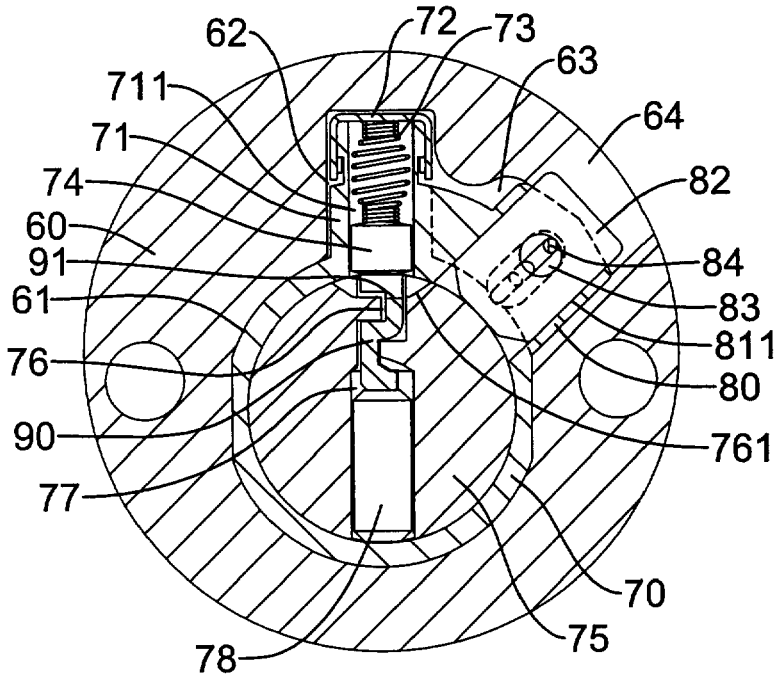
FIG.12 PRIOR ART
FIG. 12 is a front view in partial section of the conventional cylinder lock assembly in FIG. 10 with the recess in the core misaligned with and separated from the retaining tab in the core casing.
Figure 13:
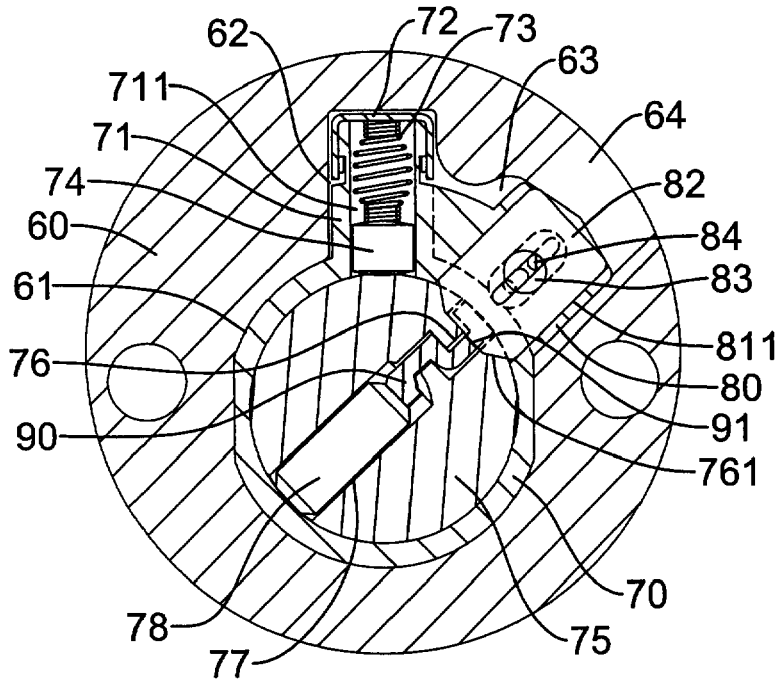
FIG.13 PRIOR ART
FIG. 13 is an operational front view in partial section of the conventional cylinder lock assembly in FIG. 12 with the recess engaging with the retaining tab to release the core casing and the core.

With reference to FIGS. 9A and 9B, a fourth embodiment of the cylinder lock assembly in accordance with the present invention has the second protrusion (30A) implemented without the boss but having a mounting slot (32A) defined in the second protrusion (30A). The second cover (34A) is implemented without the mounting bore but has the opening and a mounting tab (343A) extending perpendicularly from the second cover (34A) and mounted securely in the mounting slot (32A).

With the stepped recess (550), a user intending to detach the core casing (20) and the core (52) from the exterior housing (10) would hear and feel a crash when he rotates the key (56) with the core (52) to a specific angular position and the inside end of the retaining pin (35, 37) engaged with the stepped recess (550). The crash due to the inside end of the retaining pin (35, 37) jumps from the upper step to the lower step of the stepped recess (550) indicates the user that the core casing (20) and the core (52) is free to be detached. Therefore, the user would detached the core casing (20) and the core (52) without guessing and trying which angular position of the core (52) allows the detachment.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A cylinder lock assembly comprising:

an exterior housing having a through hole defined longitudinal through the exterior housing;

a first channel defined in the exterior housing and communicating with the through hole;

a second channel defined in the exterior housing and communicating with the through hole; and a mounting hole defined in the exterior housing and communicating with the second channel;

a core casing set having a core casing mounted slidably and detachably in the through hole in the exterior housing, having a front end, a rear end and a central hole defined longitudinally through the core casing;

a first protrusion formed on and protruding out from the core casing, mounted slidably in the first channel, and the first protrusion having multiple outer bores defined in the first protrusion and communicating with the central hole;

multiple outer tumblers mounted respectively in the outer bores;

multiple first sprints mounted respectively in the outer bores, corresponding respectively to the outer tumblers, respectively pressing against the outer tumblers inward and each first spring mounted between a first cover and a corresponding outer tumbler; and the first cover mounted on the first protrusion and covering the outer bores;

a second protrusion formed on and protruding radially from the core casing, mounted slidably in the second channel, tapered toward the core casing and having a mounting aperture defined through the second protrusion, extending radially in and communicating with the central hole and aligned with the mounting hole in the exterior housing, and the mounting aperture having an inner annular surface, an inside end and an inner annular flange formed on and protruding radially inward from the inner annular surface;

two sides being inclined;

a boss formed on and protruding out from the second protrusion; and a second cover mounted on the second protrusion and having an opening defined through the second cover and aligned with the mounting aperture, two side tabs being inclined and mounted respectively on the sides of the second protrusion and a mounting bore defined through the second cover and mounted securely around the boss;

a retaining pin mounted slidably through the mounting aperture in the second protrusion, extending in the mounting hole in the exterior housing, mounted slidably through the opening in the second cover and having an inside end having an outer annular bevel edge; and an outer annular flange formed on and protruding radially out from the retaining pin and selectively abutting the inner annular flange in the mounting aperture or the second cover; and a second spring mounted in the mounting aperture, pressing the retaining pin inward and mounted between the second cover and the outer annular flange on the retaining pin and pressing against the second cover; and a core mounted rotatably in the central hole in the core casing, having a front end;

a rear end;

a keyhole defined longitudinally through the core, extending radially out through the core and having a radial gap defined radially in the core and having two opposite inner surfaces, one inner surface selectively abutting the inside end of the retaining pin; and a stepped recess defined radially in the core and located adjacent to the other inner surface being opposite to the inner surface selectively abutting the inside end of the retaining pin and selectively engaging with the inside end of the retaining pin, and the stepped recess having an upper step and a second step located in different radial levels and an inclined surface formed on the upper step and the lower step and corresponding to the outer annular bevel edge of the inside end of the retaining pin;

multiple inner bores defined radially in the core, corresponding respectively to the outer bores in the core casing and respectively receiving the outer tumblers partially when aligned respectively with the outer bores; and multiple inner tumblers slidably mounted respectively in the inner bores and pushed inward respectively by the outer tumblers when the inner bores are aligned respectively with the outer bores;

whereby the retaining pin engaging with the stepped recess moves entirely out of the mounting hole in the exterior housing and the core casing and the core are released.

2. A cylinder lock assembly comprising:

an exterior housing having a through hole defined longitudinal through the exterior housing;

a first channel defined in the exterior housing and communicating with the through hole;

a second channel defined in the exterior housing and communicating with the through hole; and a mounting hole defined in the exterior housing and communicating with the second channel;

a core casing set having a core casing mounted slidably and detachably in the through hole in the exterior housing, having a front end, a rear end and a central hole defined longitudinally through the core casing;

a first protrusion formed on and protruding out from the core casing, mounted slidably in the first channel, and the first protrusion having multiple outer bores defined in the first protrusion and communicating with the central hole;

multiple outer tumblers mounted respectively in the outer bores;

multiple first springs mounted respectively in the outer bores, corresponding respectively to the outer tumblers, respectively pressing against the outer tumblers inward and each first spring mounted between a first cover and a corresponding outer tumbler; and the first cover mounted on the first protrusion and covering the outer bores;

a second protrusion formed on and protruding radially from the core casing, mounted slidably in the second channel, tapered toward the core casing and having a mounting aperture defined through the second protrusion, extending radially in and communicating with the central hole and aligned with the mounting hole in the exterior housing, and the mounting aperture having an inner annular surface, an inside end and an inner annular flange formed on and protruding radially inward from the inner annular surface;

two sides being inclined;

a mounting slot defined in the second protrusion; and a second cover mounted on the second protrusion and having an opening defined through the second cover and aligned with the mounting aperture, two side tabs being inclined and mounted respectively on the sides of the second protrusion and a mounting tab extending perpendicularly from the second cover and mounted securely in the mounting slot;

a retaining pin mounted slidably through the mounting aperture in the second protrusion, extending in the mounting hole in the exterior housing, mounted slidably through the opening in the second cover and having an inside end having an outer annular bevel edge; and an outer annular flange formed on and protruding radially out from the retaining pin and selectively abutting the inner annular flange in the mounting aperture or the second cover; and a second spring mounted in the mounting aperture, pressing against the retaining pin inward and mounted between the second cover and the outer annular flange on the retaining pin and pressing against the second cover; and a core mounted rotatable in the central hole in the core casing and having a front end;

a rear end;

a keyhole defined longitudinally through the core, extending radially out through the core and having a radial gap defined radially in the core and having two opposite inner surfaces, one inner surface selectively abutting the inside end of the retaining pin; and a stepped recess defined radially in the core and located adjacent to the other inner surface being opposite to the inner surface selectively abutting the inside end of the retaining pin and selectively engaging with the inside end of the retaining pin, and the stepped recess having an upper step and a second step located in different radial levels and an inclined surface formed on the upper step and the lower step and corresponding to the outer annular bevel edge of the inside end of the retaining pin;

multiple inner bores defined radially in the core, corresponding respectively to the outer bores in the core casing and respectively receiving the outer tumblers partially when aligned respectively with the outer bores; and multiple inner tumblers slidably mounted respectively in the inner bores and pushed inward respectively by the outer tumblers when the inner bores are aligned respectively with the outer bores;

whereby the retaining pin engaging with the stepped recess moves entirely out of the mounting hole in the exterior housing and the core casing and the core are released.

* * * * *